US005735760A

United States Patent [19]

Brewer

[11] Patent Number: 5,735,760

[45] Date of Patent: Apr. 7, 1998

[54] BASKETBALL NET

[76] Inventor: Dean Brewer, 1983 E. 5850 South, Ogden, Utah 84403

[21] Appl. No.: 590,925

[22] Filed: Jan. 24, 1996

[51] Int. Cl.[6] ..... A63B 63/08

[52] U.S. Cl. ..... 473/485; D21/201

[58] Field of Search ..... 473/485, 488, 473/479, 480, 481, 486, 487, 489; D21/201

[56] References Cited

U.S. PATENT DOCUMENTS

| | | | |
|---|---|---|---|
| D. 325,947 | 5/1992 | Cass | D21/201 |
| D. 354,534 | 1/1995 | Michalik | D21/201 |
| 2,579,312 | 12/1951 | Garvey . | |
| 3,761,089 | 9/1973 | Slane . | |
| 5,301,939 | 4/1994 | Ellsworth . | |

*Primary Examiner*—Steven B. Wong

*Attorney, Agent, or Firm*—Berne S. Broadbent; Dale E. Hulse

[57] ABSTRACT

A basketball net may be constructed from fabric. Appropriate fabrics may include knit fabrics made from durable materials, such as nylon thread. Monofilament nylon in a knit fabric having perforations manufactured in the fabric, may provide resilient nets capable of stretching in two dimensions. Nets may be constructed in a shape resembling a frustum of a cone. The frustum may be constructed from multiple pieces. Fabric may be laid flat, and cut in tapered pieces, having the fabric oriented in a direction selected to provide the best performance in service. Segments may be hemmed together along more-or-less vertical lines on the edges of the frustum. The net is manufactured of a fabric selected to provide a substantial fraction of its overall area in a surface for receiving an image. However, a substantial portion of the overall area of the fabric of the net may be voids for providing resilient stretching and service.

24 Claims, 4 Drawing Sheets

BASKETBALL NET

BACKGROUND

1. The Field of the Invention

This invention relates to athletic training equipment and, more particularly, to novel systems and methods for a basketball goal.

2. The Background Art

Basketball is a common sport among youths and adults, alike. Most amateur athletes (basketball players) practice their shooting techniques on private courts. A basketball goal on any basketball court is typically provided with a net. The net is typically constructed as a very wide mesh formed by cords tied at some regular spacing.

A typical basketball net may use a nylon cord of approximately ¼ inch diameter. Typical cords are comprised of a bundle of individual strands enclosed within a braided sheath. Once the braided sheath has become damaged by tearing, abrasion, accidental ripping, or the like, the individual strands within the cord quickly become destroyed as well.

Basketball nets are sometimes placed outdoors. Sun and weather may take their toll on a basketball net which is not quick to dry. That is, a diameter of approximately ¼ inch means that the central fibers of the cord in the net are ⅛ inch from a surface. Thinner materials would dry more quickly. Thus, water would not be left in a net for a long period of time, if the net could be dried faster.

One principal cause of damage in basketball nets is rough play by users. For example, it is not uncommon for youngsters to grab the mesh of a net, or to hang from the net. Since a net is only supported at certain discrete locations, substantial strain and stress may be applied at those support points.

Likewise, such a combination of cords threaded over the thin hooks of a basketball hoop, and knots tied at periodic junctions in the net, produce stress concentrations in the cords and fibers of the net. A knotted, kinked, tightly constricted, or otherwise restricted cord may have a local stress concentration that effectively multiplies the load applied by a user hanging from a net. The result is that a net may be damaged more than is apparent.

A typical basketball net is a rather generic, nondescript item. Personalizing articles of clothing, particularly sportswear and athletic gear, with an individual's name, with the name of a school, or with the name of a commercial team, has long been recognized as a powerful marketing device. Owing to the nature of its construction, a typical basketball net is not adapted to receive a logo, marking, image, or the like. Whether a team is a high school team, a national franchise, or a local city league, its logo may have meaning to some population. Thus, the desirability of placing some form of logo or name on a basketball net may be very significant.

A meaningful image requires sufficient surface area to receive the image. Thus, although an image may have gaps, or be formed in a mosaic-type of structure, surface may visually predominate over intermediate voids or be sufficient for forming an aesthetically pleasing image.

Thus, what is needed is a basketball net that may be adaptable to quick drying in the presence of moisture in an outdoor environment, that is not well adapted to grabbing or hanging by a user, and which is adaptable to receive an image associated with some team or organization of significance to a user.

BRIEF SUMMARY AND OBJECTS OF THE INVENTION

In view of the foregoing, it is a primary object of the present invention to provide a basketball net for use in various environments.

It is an object of the present invention to provide a basketball net that is durable, functional, and adapted to prevent damage from users hanging from the net or otherwise applying undue force.

It is another object of the invention to provide a basketball net adapted to rapid drying when left in an outdoor environment attached to a basketball goal.

It is a further object of the invention to provide a basketball net adapted to receive an image printed thereon to be readily visible and distinguishable by a user, the image being associated with some organization of significance to the user.

Consistent with the foregoing objects, and in accordance with the invention as embodied and broadly described herein, a net is disclosed, in one embodiment of the present invention, comprised of a fabric. In one currently preferred embodiment, the fabric may be of a knit type. A monofilament nylon knit fabric has been found well adapted to making a net.

In one embodiment, the net may be comprised of three panels cut as segments of a circle. The segments of a circle may be segmented between two values of a zimuth (circumferential direction) and two values of radius. These may be hemmed together to form a frustum of a cone. A tube or sleeve of fabric may be sewn to extend along the upper circumference of the frustum of a cone having the larger diameter or circumference of the frustum positioned on top. The smaller diameter of the frustum may be positioned as the lower-most edge, and may be hemmed. An axis of the frustum extending longitudinally is an axis (of point symmetry) of the circular basketball hoop to which the net may be secured.

The net may be formed as a frustum manufactured from a single piece of fabric. However, since fabric typically has non-isotropic properties, an assembled structure using several fabric segments provides certain advantages, such as more uniformity of properties, easier handling, and the like.

In some embodiments, the segments used to construct a net may appear as segments of a circle, each having an outer radius or diameter and inner radius or diameter with a radial ray or azimuth extending linearly along each edge (at the zimuthal angle) between the two radii. That is, each segment may be formed to have an inner radius and an outer radius, with an arc extending between a first azimuthal edge and a second azimuthal edge at each of the radii. Thus, the segment may appear something like a trapezoid, except that two arcuate edges are curvilinear, rather than straight.

The net may have a thickness of as little as a few thousandths of an inch. Thicker fabrics may also be suitable.

In one embodiment, a thickness of approximately ten to twenty-five thousandths of an inch, in a knit, nylon fabric has been found suitable. A thickness of up to 250 thousandths is acceptable, but more expensive. In one embodiment the fabric of the net may be made of monofilament fiber in a woven, perforated, knit fabric to provide appropriate durability, resilience, and deformability.

In one embodiment, the fabric of the net may be woven to have perforations. The perforations may provide for additional deformation of the fabric in response to a ball passing through the net. That is, knit fabrics have a property of expanding in one direction while contracting in an orthogonal direction in response to an applied force. As a basketball passes through the net, the net may expand in one direction, while contracting in an orthogonal direction to accommodate the ball.

Several advantages accrue to a net made in accordance with the invention. For example, since the fabric is relatively thin, having a large surface area in comparison with its overall volume, the net will dry very quickly. Since the net may have no perforations, or a relatively small perforation, users cannot readily grab the net with their fingers, or hang from the net. Also, because the net may have a large contiguous surface area, whether or not perforated, the net may be adaptable to receive a silk-screened image, a dyed image, or a heat-transferred image.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
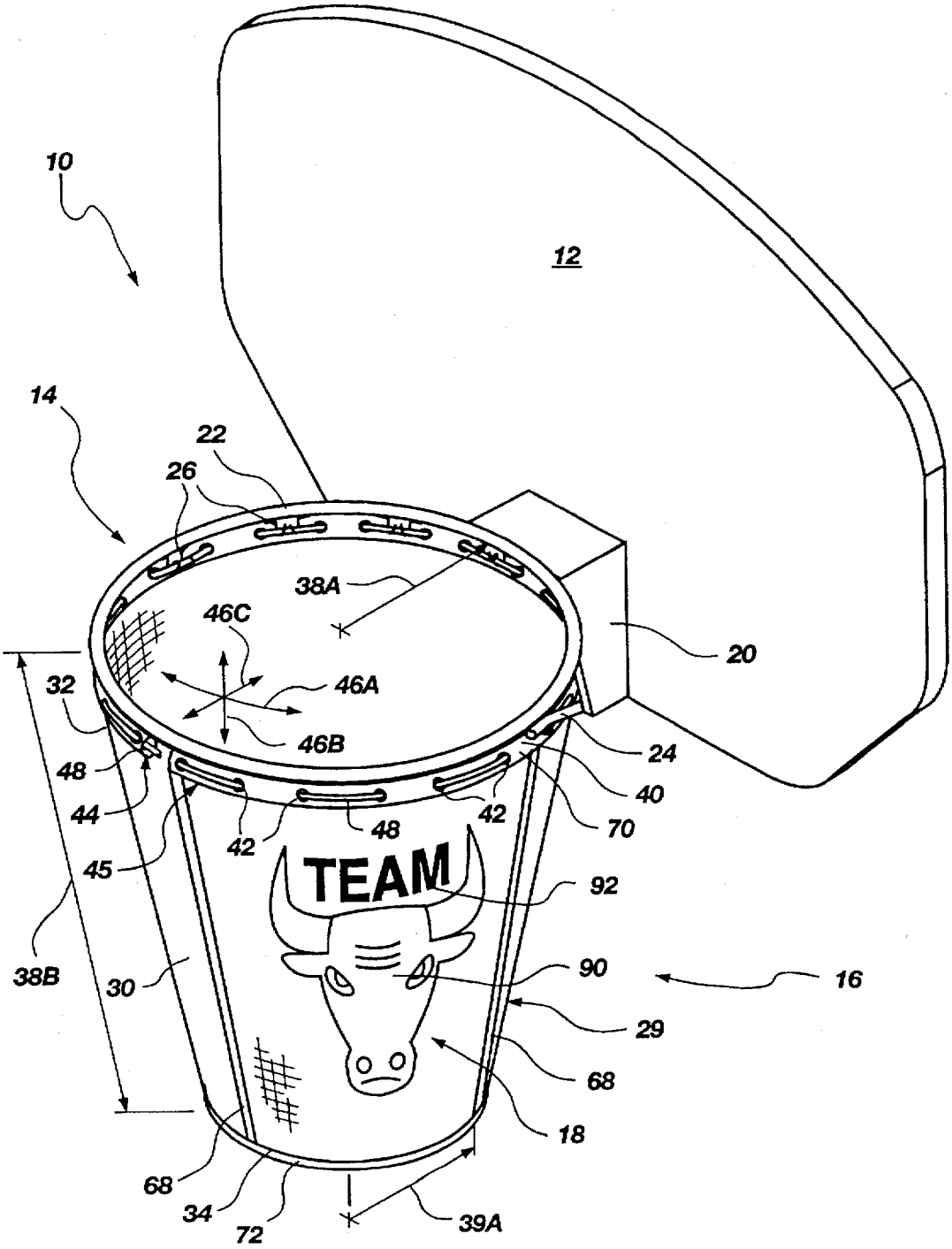
FIG. 1 is a perspective view of one embodiment of an apparatus made in accordance with the invention.

It will be readily understood that the components of the present invention, as generally described and illustrated in the FIGS. 1–5 herein, could be arranged and designed in a wide variety of different configurations. Thus, the following more detailed description of the embodiments of the apparatus and method of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout. The apparatus is best understood by reference to FIGS. 1–5, and particularly to FIG. 1.

Referring now to FIGS. 1–5, a goal 10 for a basketball may be formed with a backboard 12 for stopping the ball, and for banking shots into a hoop 14. Suspended below the hoop 14 may be a net 16 made in accordance with the invention. The net 16 may have printed thereon an image 18 or graphic 18 representing, for example, a name, logo, slogan, or the like. In one embodiment, the image 18 may be a licensed logo of a favorite team. In another embodiment, the image 18 may be an advertiser's slogan.

The hoop 14 may be formed to have a mount 20 for connecting a rim 22 to the backboard 12. The mount 20 may be rigid, or deflectable. Some mounts 20 actually contain load-bearing shock absorbers for resisting deflection, but complying nevertheless. Springs, oil dampers, and the like may be included within the mount 20 to form a more durable goal 10.

The rim 22 may be formed of a stock of metal rod, such as steel rod, having a circular or oval cross-section. The rim 22 is circular in form, and may rely upon a brace 24, such as, for example, the gusset 24 illustrated, to increase the effective strength and stiffness of the rim 22. The brace 24 is typically fastened to the mount 20, either rigidly or by some moveable member for operating a shock absorbing mechanism.

Hooks 26 may be permanently fastened to the rim 22. The hooks may be of a conventional type, curving more than 270 degrees in order to present no sharp edges or any impediment to a ball. The hooks 26 typically extend below the rim 22.

The net 16 may be formed as a chute 29 formed in the shape of a frustum 29 of a cone. In one embodiment, the chute 29 may be formed of a layer 30 or sheath 30 of fabric. In one presently preferred embodiment, the fabric layer 30 may be a knit fabric. A monofilament nylon thread has been found suitable in one embodiment for forming the knit fabric of the layer 30. The thickness 31 of the fabric may vary according to the thread, the weave, and other parameters familiar in the textile industry. A thickness from about 0.025 inch to about 0.250 inch may be sufficiently durable. In one embodiment, the net 16 may be formed of a woven fabric of a thickness from about 0.002 to about 0.05 inches thick. Woven fabrics may be very durable, yet very thin.

For example, woven nylons may be from two or three thousandths of an inch thick to fifteen thousandths with good durability. In one presently preferred embodiment, a knit fabric may be from about 6 to 25 thousandths of an inch. Knit fabrics tend to be thicker due to the knit nature of their weave. Thicker threads may result in fabrics having larger thickness 31. Also, more complex weaves sometimes provide additional bulk in the thickness 31.

The fabric layer 30 of the net 16 may extend from a top edge 32 to a bottom edge 34. The fabric layer 30 need not be everywhere continuous, although it may be continuous anywhere. For example, apertures 36 or perforations 36 may be formed in the layer 30. Moreover, the apertures 36 may actually be woven directly into the fabric of which the layer 30 is cut. For example, referring to FIGS. 1–3, a fabric layer 30 may be cut from a flat piece of fabric, or may be assembled from several flat pieces of fabric.

Fabric typically has a nap, thread orientation, or other feature that affects some property that is, accordingly, clearly directional. The directionality may be more pronounced in woven fabrics than knitted fabrics. A knitted fabric may nevertheless have some directionality to its properties. Thus, isotropic properties, such as may be encountered in homogeneous metals having uniformproperties in all directions, are not expected in all three directions of most fabrics. Thus, a segment 37 (see FIG. 2) may be formed to represent only a portion of the overall chute 29 of the net 16.

The net 16 may be characterized as a frustum 29 of a cone, having a radius **38*a* and a length 38*b* near the rim 22. The radius 39*a* may be substantially smaller than the radius 38*a*. This difference contributes to the function of a net 16. That is, when a ball passes through the hoop 14, the net 16 may restrict the ball to movement in a predominately axial 46*b* direction, rather than a radial 46*c* direction. To the extent that a ball is moving in a radial direction 46*c*, the net may be deflected, but the ball must change direction before the more restrictive radius 39*a* will allow the ball to pass out of the net 16**.

Since the net 16 may be fabricated of a knit fabric, the net may actually expand and contract in radial **46*c*, axial 46*b*, and circumferential 46*a* directions. For example, a ball may hit the net 16 with a high speed, causing a deflection (expansion) of the net 16 in an axial 46*b* direction. However, such an expansion causes a corresponding contraction in the fabric of the net 16 in a circumferential 46*a* direction. Thus, the ball may effectively make a narrower chute 29, which cannot expand in a circumferential direction 46*a* until the ball has slowed down, and the net has expanded in the circumferential 46*a* direction with a corresponding deflection (contraction) in the axial 46*b*** direction.

The fabric selected for forming the layer 30 or sheet 30 may be formed of a knitted material. One suitable material may be a monofilament nylon thread knitted to permit deflection similar to the Poisson effect. That is, materials (solids) exhibit a property related to the conservation of mass principals, along with the principles of solid mechanics. The Poisson effect describes how a solid, when subjected to a force in a first direction, will deflect in the direction of the force. However, according to the Poisson effect, the material will move in a direction (tension/compression) or sense opposite that of the force along axes orthogonal to the axis of the force. Thus, a solid placed in tension will extend in the direction of the force and contract in the directions orthogonal to the force. Similarly, a solid placed in compression, assuming isotropy in the solid material, typically will expand in the directions orthogonal to the direction of the applied compressive force.

Knit fabrics, although not relying on the Poisson effect on a large scale, exhibit a similar behavior. As the knit fabric is drawn in one direction under a tensile or tension force, the material contracts in a direction orthogonal to the direction of the force. The filaments or threads of the knitted fabric are free to align with the force, extending to the maximum extent possible.

In one embodiment of an apparatus made in accordance with the invention, the apertures 36 or perforations 36 in the sheet 30 of fabric from which the net 16 is constructed, may form a substantial portion of the overall area, or projected area, of the fabric as viewed normal to the two largest dimensions. The apertures may be characterized by a width 80 and a height 82. Each perforation 36 may be spaced a spacing distance 84 laterally from an adjacent aperture 36. Likewise, each aperture 36 may be spaced a spacing distance 86 in a direction orthogonal to the lateral direction; for example, vertically, as viewed by a user in FIG. 3.

The apertures 36 may provide more freedom of motion and deflection of the fibers of the fabric in the sheet 30. For example, knit fabric must move to some extent at the level of an individual thread or filament. Movement, relative movement, between contacting threads or filaments results in abrasion. Abrasion may lead to failure of an individual thread, or of a major portion of the sheet 30. A certain amount of abrasion is natural, and tolerable. Nevertheless, as a wear mechanism, abrasion is preferably reduced. Thus, the spacing 84 and spacing 86 may be selected to correspond to the width 80 and height 82 in a relation selected to be effective to minimize abrasion and wear as measured by the life of the net or standard textile tests. Thus, a maximum flexibility in an axial direction **46*b* and a circumferential direction 46*c* may be obtained by suitable selection of the width 80 and height 82, as well as the spacings 84, 86**.

Figure 4:
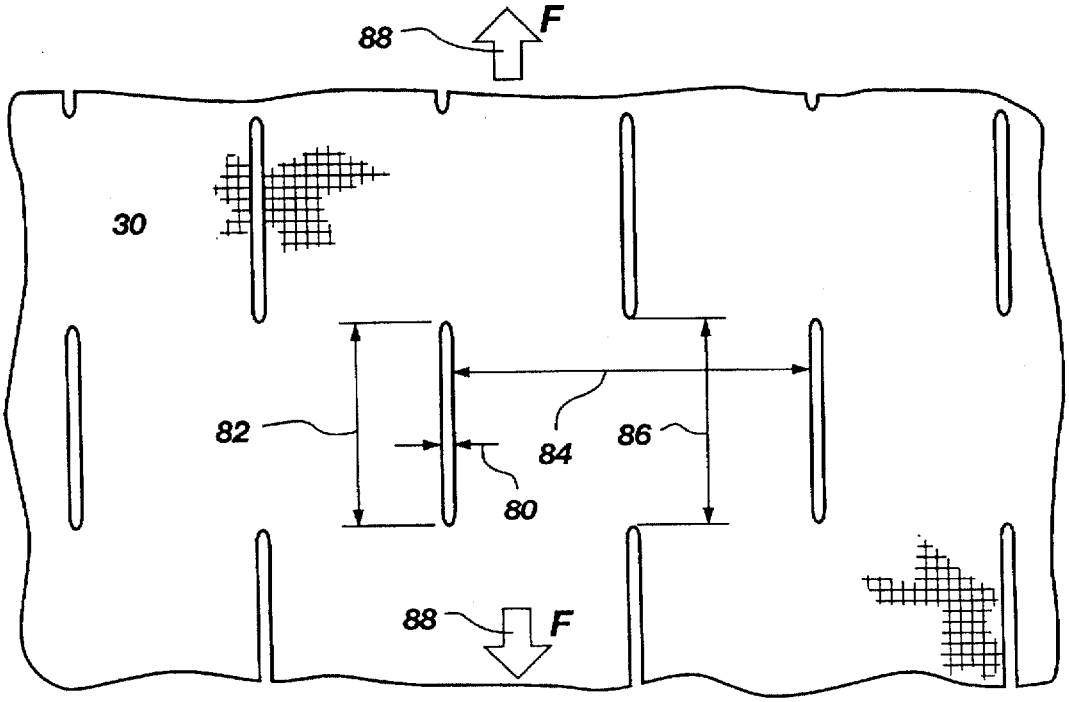
FIG. 4 is a plan view of the fabric of FIG. 3 with a force applied in one direction.
Figure 5:
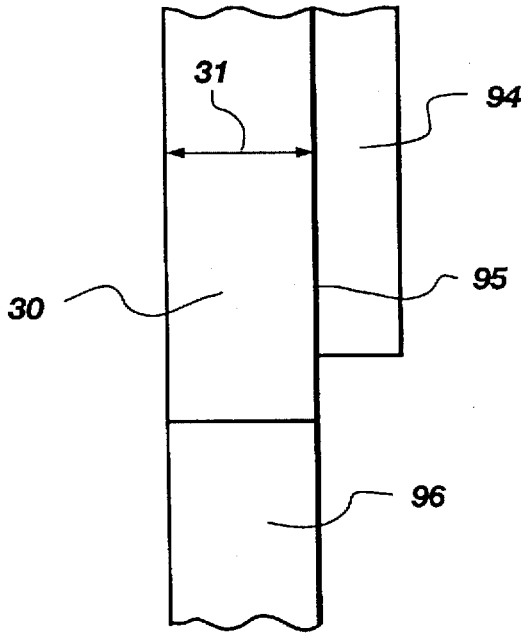
FIG. 5 is an elevation cross-sectional view of printed fabric suitable for constructing the apparatus of FIG. 1.

Referring now to FIG. 4, a force 88 applied to the layer 30 may align the threads of the fabric material of the sheet 30. Likewise, the apertures 36 may be aligned, becoming mere slits oriented along the direction of the force 88. The width 80 may be reduced to approximately 0. The height 82 may be extended to the maximum extent tolerated by the material spanning the spacing 86.

In one embodiment of an apparatus made in accordance with the invention, a net 16 may be sized such that the basketball will not pass through the net 16 at its hanging dimensions. For example, without external force, other than the weight of the net 16, the apertures 36 may exist at some nominal size close to the width 80 and height 82 existing during manufacture. One embodiment of a net 16 may restrict the size of the radius **39*a* and corresponding circumference at the bottom edge 34 of the net 16 to not allow a basketball to pass. In order to pass completely through the net 16, a ball may need to slow down or stop until the width 80 and the spacing 84 have extended to a maximum value at the expense of the height 82 and the spacing 86, which reduce to some lower value. Thus, the response of the net 16 may be to slow down a ball, which is allowed to pass, but only after being choked through the net 16**.

One can also visualize, for example, the effect of a rapidly moving ball producing some frictional force in an axial direction **46*b* while passing through the net 16. To the extent that the speed of the ball tends to draw the net 16 with the ball, the apertures 36 may extend in height 82 and reduce in width 80, and the net 16 tightens to restrict movement of the ball. Once the ball has slowed down, reducing any force applied to the net 16, the fabric of the net 16 may adjust to provide more suitable width 80, as well as spacing 84, allowing the ball to pass through the net 16. Thus, a net 16** made in accordance with the instant invention may provide several functional needs supplied by a conventional net, but in a fabric, rather than a true net made of knotted cords.

Fabrics, being, typically, considerably thinner than cords, may place virtually every thread within the sheet 30 adjacent to surrounding air. Thus, a single thread radius may stand between a water molecule trapped in the net 16 and the air to which the water should evaporate. Moreover, to the extent that nylon monofilament thread is used, water absorption rates may be relatively small. That is, surface tension may hold water within small gaps between threads, but each individual thread may have access to the surrounding air. By contrast, a bundle of nylon filaments captured within a braided sleeve, may hold water by capillary action between themselves, and within the sleeve. Thus, the drying rates of nets 16 made in accordance with the invention may be orders of magnitude faster, in open air, than corresponding conventional nets.

An image 18 may include a graphic 90 or text 92. Some combination of text 92 and graphics 90 may be combined in a decal, silk screened image, coating, or the like. Thus, a pigment layer 94 may be applied to a surface 95 of the fabric sheet 30. Some pigments that have been found suitable include polymeric and elastomeric fabric paints such as may be used on athletic jerseys, t-shirts, and the like, in silk screening processes. Similarly, inks that may soak into individual fibers or stain individual fibers may be used. That is, the pigment layer 94 may be more closely aligned with a paint than an ink, forming a bond with the fabric of the sheet 30. An ink or dye, by contrast, may actually stain the fibers within the sheet 30. For example, the dyed fibers 96 may be died before construction of the net 16 from the sheets 30 or the segments 37. Also, in certain embodiments of an apparatus made in accordance with the invention, a net 16 may be subjected to a chemical or thermal process to dye the dyed fibers 96.

In operation, the net 16 may be attached by the cord 48 to a number of hooks 26 disposed along the rim 22 of a hoop 14. The cord 48 may be laced through apertures 42 inherent in the sleeve 40, or placed in the sleeve 40 or tube 40, adapted for the purpose of receiving the cord 48 to be connected by some fastener to the hoop. Thus, the cord 48 may function similarly to the top-most loops of a conventional basketball net or by another mechanism.

In one embodiment of an apparatus 10 made in accordance with the invention the net 10 may be made of segments 37 of fabric extending radially a distance 62 between a bottom edge 34 at a first radius 64, and a top edge 32 at a second radius 66, measured from a center point 65. The segment 37 may be formed to extend circumferentially between a first edge 52, and a second edge 54. The bottom edge may be arcuate, extending a distance 51 circumferentially to permit proper actuation of the net 10 in restricting movement of a ball passing through the net.

The edges 52, 54 may be slightly arcuate, as edges 56, 58, respectively. The reduction 60 or gap 60 between a straight edge 56, 58 and arcuate edge 52, 54, may be selected to give a preferred appearance. The shape of the net 10 may be made to neck down more by use of this construction, as well as making the top edge 32 to have a total circumfernce 50 less than that of the rim 22 of the hoop 14. Either approach or both may be made for shaping the net 10, although knit fabrics may be made to hang properly when formed in three segments 37, even when each is cut or otherwise formed straight along each of the edges 52, 54, and 32.

The dimensions or lengths 50, 51, 62, and 64 may be selected to give the dynamic response of the net 10 to the passage of a ball therethrough. These lengths 50, 51, 62, 64 may be selected to be effective to slow the downward velocity of the ball. In one embodiment, the net 10 is sized effectively to direct the ball back toward the person who shot the ball if the ball passes through the net withough striking the rim 22 or backboard 12, or bouncing on the rim 22 (a net ball, or swisher). Moreover, the net is effective to make the familiar swishing sound as the ball passes through the net on a net ball or swisher shot. The net returns a swish ball to a player, if the ball is shot with the correct arc and spin to be a net ball, so the performance is equivalent to that of a conventional net.

Figure 2:
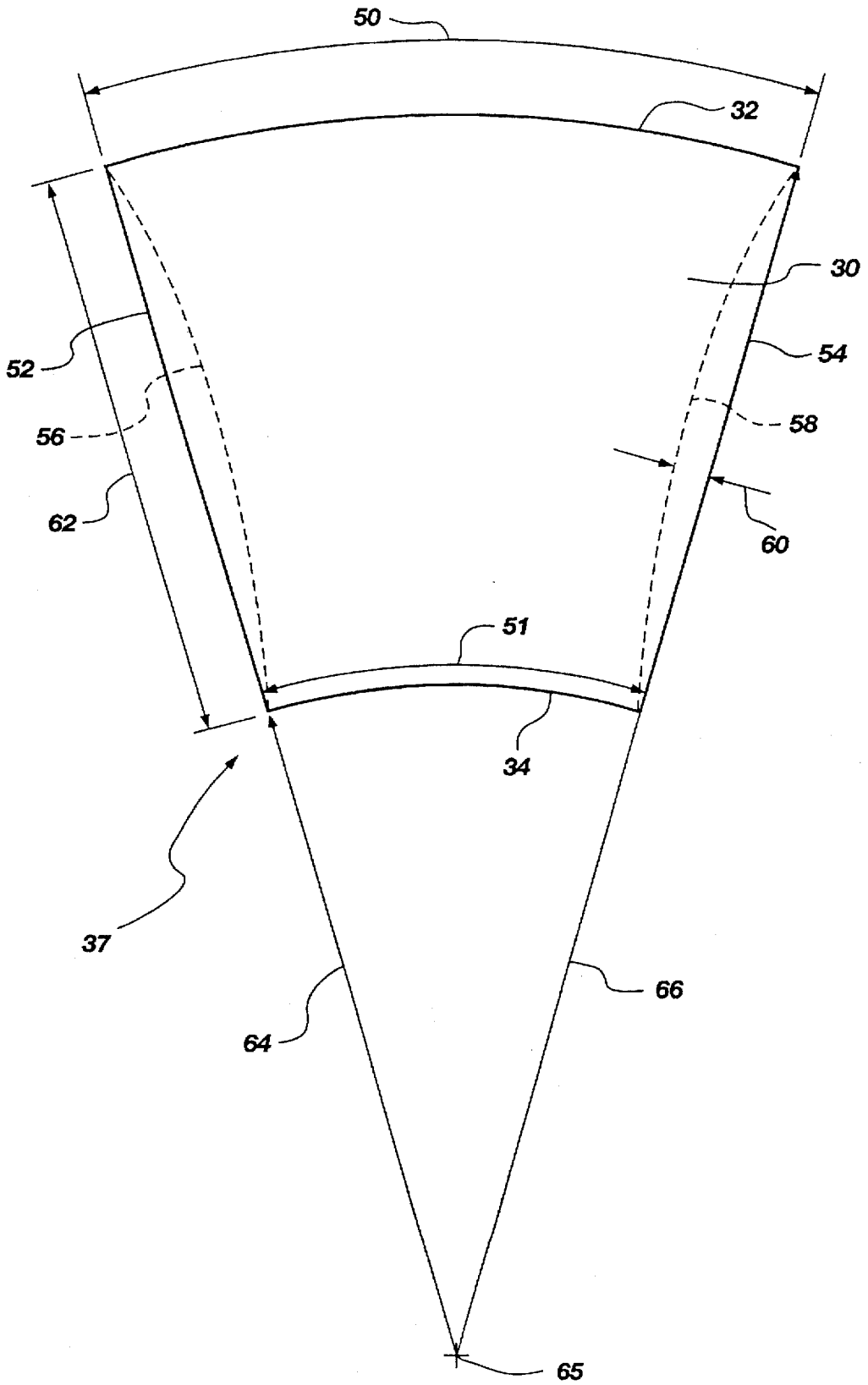
FIG. 2 is a plan view of a segment of fabric of the apparatus of FIG. 1, laid flat, prior to assembly.
Figure 3:
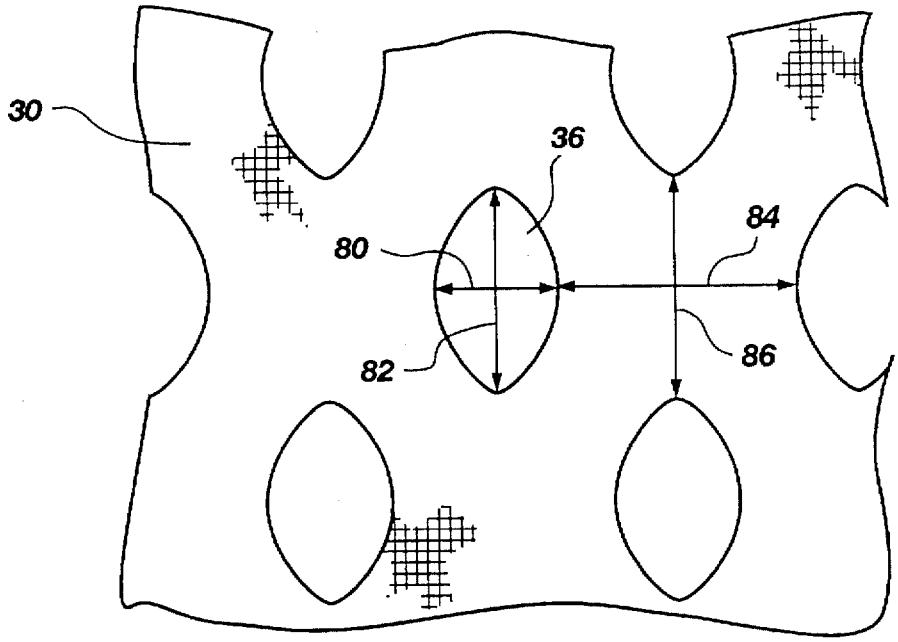
FIG. 3 is a plan view of a sample of fabric suitable for one embodiment of the apparatus of FIG. 1.

The fabric of the net 10 may be a "porthole mesh". The edge 32, if three segments 37 are used may be 18" straight across whether the edge 32 is straight or arcuate. The side edges may be approximately 19 inches long, while the bottom edge 34 may be 9 inches across. However, the bottom edge 34 performs better if it is arcuate in shape as illustrated in FIG. 2. The length may be measured circumferentially along the arc or across the arc as a chord. In general, the length 50 along the top edge 32 may be twice the length 51 of the bottom edge 34, with the length 62 approximately equal to the length 50 along the top edge 32.

In practice, a void fraction (area of apertures 36 to total projected area) of ⅓ of the overall projected area of the net 16 has been found suitable. Nets 16 with no void fraction may be constructed. Void fractions of 20% to 50% are deemed very satisfactory for providing adequate service and for receiving an image that remains recognizable. In certain circumstances, a void fraction of from about 10% to about 90% may still permit easy viewing of an applied image, provided that the void fraction is sufficiently widely dispersed in relatively small voids, connected by substantial fabric.

For example, a conventional net has a large concentration of cord surrounding a very large void spaces. Thus, no image resolution or integrity is typically possible. If sufficiently small voids are distributed among a latticework of fabric having a large void fraction, an image may still be printed to be recognizable on the net 16.

The best image recognition is provided if the void fraction is from about to 20% to about 50% of the overall area of the net 16. A knit fabric of monofilament nylon having a void fraction of approximately 25% may provide an extension of 20–25% in two orthogonal directions within the plane of the flat fabric. Such a fabric has been found suitable.

It is helpful to characterize thickness 31 in terms of an aspect ratio. An aspect ratio is the ratio of a significant dimension (such as length, width, or thickness) to another dimension associated with the fabric.

An aspect ratio may be thought of as a ratio of one dimension (e.g. thickness 31) to another orthogonal dimension, such as a significant width or length (e.g. perforation width 80 or length 82; unbroken fabric width 84 or length 86 between perforations.).

The aspect ratio of perforations to continuous fabric expanse may characterize a fabric. Here, unless otherwise specified thickness aspect ratio is the ratio of fabric thickness 31 to the shortest dimension 84 of fabric between perforations. In an apparatus made in accordance to the invention, the thickness aspect ratio is less than one, often less than a tenth. By contrast, conventional nets typically have a thickness aspect ratio of one.

A thickness aspect ratio less than one may enhance drying, and a thickness aspect ratio of less than 4 provides good drying. A thickness aspect ratio of less than 6 to 12 provides very rapid, superior, drying in open, unsaturated air.

In an apparatus made in accordance with the invention, the aspect ratio of a dimension 82 (80) of a perforation to the corresponding fabric distance 86 (84) between adjacent perforations may be defined as a perforation aspect ratio. It may vary between various embodiments. An apparatus made in accordance with the invention differs from conventional nets in that this aspect ratio is typically less than 10, and is close to one in many preferred embodiments. In the illustrated embodiment of FIG. 3, the perforation aspect ratios are approximately one, and approximately one half, in the two directions **46*b*, 46*c***, respectively.

By contrast, this perforation aspect ratio for conventional nets is typically greater than 12. For the purposes here, unless specified differently, this is the ratio intended as perforation aspect ratio, a dimensionless comparison of two distances.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method for making a basketball net adapted to be suspended from a basketball goal comprising a circular hoop having an axis of symmetry, the method comprising:

providing a quantity of knit fabric;

forming a sheet from the quantity of fabric, the sheet being shaped as a segment of a circle to extend from a bottom edge, corresponding to a first radius and first arclength, to a top edge, corresponding to a second radius and second arclength, and from a left edge, corresponding to a first azimuth, to a right edge, corresponding to a second azimuth;

connecting the left edge to the right edge to form the sheet into a frustum of a cone having a longitudinal axis;

forming a suspension device proximate the top edge; and connecting the suspension device to the hoop to substantially align the longitudinal axis with the axis of symmetry.

2. The method of claim 1 further comprising printing an image on a surface of the sheet.

3. The method of claim 1 further comprising selecting a fabric adapted to receive an image on a surface thereof.

4. The method of claim 3 further comprising selecting a fabric having a perforation aspect ratio of less than 10.

5. The method of claim 4 further comprising selecting a thickness aspect ratio less than one.

6. The method of claim 1 further comprising selecting a fabric having a thread effective to resist abrasion and breakage.

7. The method of claim 1 further comprising selecting a fabric having an effective projected area effective to receive an image printed thereon.

8. The method of claim 1 further comprising selecting a fabric adapted to be extendible in at least one direction in response to application of a force.

9. The method of claim 1 further comprising an initial step of selecting a fabric having perforations comprising from about one tenth to about nine tenths of the projected area of a surface of the fabric.

10. The method of claim 1 wherein forming further comprises cutting a plurality of pieces from the quantity of fabric and sewing the pieces together to form the sheet.

11. The method of claim 10 further comprising printing an image on at least one piece of the plurality of pieces prior to sewing.

12. The method of claim 1 further comprising hemming the bottom edge.

13. The method of claim 1 further comprising forming a tube of fabric by a hem proximate the top edge.

14. The method of claim 13 further comprising suspending the tube of fabric from the basketball goal.

15. A net for suspension from a goal of the type comprising a circular hoop for basketball, the hoop having an axis of point symmetry, the net comprising:

a sheet of knit fabric shaped to lie on a flat surface as substantially a segment of a circle to extend from a bottom edge, corresponding to a first radius and first arclength, to a top edge, corresponding to a second radius and second arclength, and from a left edge, corresponding to a first azimuth, to a right edge, corresponding to a second azimuth;

a hem comprising the left edge secured by a fastener to the right edge to form the sheet into a frustum of a cone having a top circumference substantially equal to the second arclength, a bottom circumference substantially equal to the first arclength, and a longitudinal axis;

a suspension device positioned proximate the top edge to be effective to connect the suspension device to the hoop to substantially align the longitudinal axis with the axis of point symmetry.

16. The apparatus of claim 15 further comprising an image formed of a resin adapted to adhere to the sheet and applied to a surface of the sheet.

17. The apparatus of claim 15, wherein the knit fabric is selected to be effective to promote a drying time less than a drying time of a conventional net made of cord.

18. The apparatus of claim 15, wherein the knit fabric further comprises a textile having an aspect ratio of surface area to thickness greater than 4.

19. The apparatus of claim 15, wherein the knit fabric is selected to be effective to resist abrasion for a number of cycles at least double the number of cycles for a cotton fabric in a standard abrasion test.

20. The apparatus of claim 15 further, wherein the knit fabric is selected to be extendible from about 10 to 50 percent of an initial length in at least one direction in response to application of a force in the at least one direction.

21. The apparatus of claim 15, wherein the knit fabric is selected to have perforations comprising from about one tenth to about nine tenths of the projected area of a surface of the fabric.

22. The apparatus of claim 15 further comprising a plurality of pieces of the knit fabric sewn together to form the sheet.

23. The apparatus of claim 22 further comprising an image formed of resin adhered to a surface of at least one piece of the plurality of pieces.

24. The apparatus of claim 15 further comprising a tube of fabric integral to the net, and formed proximate the top edge.

* * * * *